US007390606B2

(12) United States Patent
Patel et al.

(10) Patent No.: US 7,390,606 B2
(45) Date of Patent: Jun. 24, 2008

(54) EMULSION AGGREGATION TONER INCORPORATING ALUMINIZED SILICA AS A COAGULATING AGENT

(75) Inventors: Raj D. Patel, Oakville (CA); Edward G. Zwartz, Mississauga (CA); Biritawit Asfaw, Oakville (CA)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 11/250,567

(22) Filed: Oct. 17, 2005

(65) Prior Publication Data

US 2007/0087280 A1 Apr. 19, 2007

(51) Int. Cl.
*G03G 9/093* (2006.01)

(52) U.S. Cl. ..... 430/110.2; 430/137.14

(58) Field of Classification Search ..... 430/108.6, 430/108.7, 108.8, 109.3, 110.2, 137.14
See application file for complete search history.

(56) References Cited

U.S. PATENT DOCUMENTS

| | | | |
|---|---|---|---|
| 3,847,604 | A | 11/1974 | Hagenbach et al. |
| 4,338,390 | A | 7/1982 | Lu |
| 4,533,617 | A | 8/1985 | Inoue et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,462,828 | A | 10/1995 | Moffat et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,869,215 | A | 2/1999 | Ong et al. |
| 6,120,967 | A | 9/2000 | Hopper et al. |
| 6,416,920 | B1 | 7/2002 | Hopper et al. |
| 6,576,389 | B2 | 6/2003 | Vanbesien et al. |
| 6,942,954 | B2 * | 9/2005 | Patel et al. ..... 430/137.1 |

OTHER PUBLICATIONS

Diamond, Arthur S & David Weiss (eds.) Handbook of Imaging Materials, 2nd ed.. New York: Marcel-Dekker, Inc. (Nov. 2001) pp. 176-182, 184, 187, 188.*

European Search Report mailed Feb. 16, 2007.

* cited by examiner

*Primary Examiner*—Christopher RoDee
(74) *Attorney, Agent, or Firm*—Oliff & Berridge, PLC

(57) ABSTRACT

The toner includes emulsion aggregation toner particles having a core and a shell. The core includes binder including a first non-crosslinked styrene acrylate polymer and a crosslinked styrene acrylate polymer, at least one colorant, at least one wax, and aluminized silica. The shell includes a second non-crosslinked styrene acrylate polymer that is preferably the same as the non-crosslinked styrene acrylate polymer of the core. The aluminized silica is advantageously used as a coagulant in the emulsion aggregation formation of the toner. A developer containing the toner and a method of forming an image using the toner are also described.

13 Claims, No Drawings

EMULSION AGGREGATION TONER INCORPORATING ALUMINIZED SILICA AS A COAGULATING AGENT

BACKGROUND

Described herein are toners, and developers containing the toners, for use in forming and developing images of good quality, the toner including therein an aluminized silica used as a coagulant during the emulsion aggregation step of forming the toner.

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, each incorporated herein by reference in its entirety.

One main type of emulsion aggregation toner includes emulsion aggregation toners that are acrylate based, e.g., styrene acrylate toner particles. See, for example, U.S. Pat. No. 6,120,967, incorporated herein by reference in its entirety, as one example.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are optionally heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

U.S. Pat. No. 6,416,920, incorporated herein by reference in its entirety, describes a process for the preparation of toner by, for example, mixing a colorant, a latex, optionally a wax and a water solubilized silica with an alumina coating or an aluminized silica as a coagulant. See the Abstract. However, this patent does not describe or suggest the advantages associated with the use of an aluminized silica coagulant in the specific emulsion aggregation toner described herein.

What is still desired is a styrene acrylate emulsion aggregation toner that can achieve excellent print quality with particularly controlled gloss properties.

SUMMARY

In embodiments, described is a toner comprising emulsion aggregation toner particles comprising a core and a shell, wherein the core is comprised of binder including a first non-crosslinked styrene acrylate polymer and a crosslinked styrene acrylate polymer, at least one colorant, at least one wax, and aluminized silica, and wherein the shell comprises a second non-crosslinked styrene acrylate polymer. The non-crosslinked styrene acrylate polymer of the core and the shell may be the same.

In further embodiments, described is a developer comprising the toner in combination with carrier particles.

In still further embodiments, described is a method of making a toner comprising emulsion aggregation toner particles comprising a core and a shell, wherein the core is comprised of binder including a first non-crosslinked styrene acrylate polymer and a crosslinked styrene acrylate polymer, at least one colorant, at least one wax, and aluminized silica, and wherein the shell comprises a second non-crosslinked styrene acrylate polymer, the method comprising:

obtaining a latex of the first non-crosslinked styrene acrylate polymer, a latex of the second non-crosslinked styrene acrylate polymer, a latex of the crosslinked styrene acrylate polymer, an aqueous dispersion of the at least one colorant, an aqueous dispersion of the at least one wax, and an aqueous dispersion of the aluminized silica, forming a mixture of the latex of the first non-crosslinked styrene acrylate polymer, the latex of the crosslinked styrene acrylate polymer, the aqueous dispersion of the at least one colorant, and the aqueous dispersion of the at least one wax, adding some or all of the aqueous dispersion of the aluminized silica to the mixture, stirring the mixture, and heating the mixture to a temperature below a glass transition temperature of the first non-crosslinked styrene acrylate polymer and the crosslinked styrene acrylate polymer, any remaining portion of the aqueous dispersion of the aluminized silica being added to the mixture during the heating, maintaining the temperature of heating to form aggregated toner particles, adding the latex of the second non-crosslinked styrene acrylate polymer particles to the aggregated toner particles to form a shell thereon, after formation of the shell, stopping further aggregation by adjusting the pH and raising the temperature to at least about 90° C. to coalesce the aggregated particles, and subsequently cooling, optionally washing, and recovering the emulsion aggregation toner particles.

EMBODIMENTS

The toner particles described herein are comprised of binder, at least one colorant, at least one wax, and aluminized silica. Each of these components of the toner particles is further described below.

In embodiments, the binder is comprised of a mixture of two polymer materials, a first non-crosslinked polymer and a second crosslinked polymer. While the non-crosslinked and crosslinked polymers may be comprised of the same styrene acrylate polymer materials, such is not required. The polymers described below may be suitably used as either or both of the non-crosslinked and crosslinked polymers of the binder.

In embodiments, the polymer(s) of the binder may be an acrylate-containing polymer, for example styrene acrylate polymer. Illustrative examples of specific polymers for the binder include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly (propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers. The alkyl group in the aforementioned polymers may be any alkyl group without limitation, although $C_1$-$C_{12}$ alkyl groups are more suitable, for example including methyl, ethyl, propyl and butyl. As the aryl group, any aryl group may be used without limitation.

In embodiments, both the non-crosslinked polymer and the crosslinked polymer are comprised of a styrene-alkyl acrylate. For example, the styrene-alkyl acrylate may be a styrene-butyl acrylate polymer, such as a styrene-butyl acrylate-β-carboxyethyl acrylate polymer.

The monomers used in making the polymer binder are not limited, and the monomers utilized may include any one or more of, for example, styrene, acrylates such as methacrylates, butylacrylates, β-carboxyethyl acrylate (β-CEA), etc., butadiene, isoprene, acrylic acid, methacrylic acid, itaconic acid, acrylonitrile, benzenes such as divinylbenzene, etc., and the like.

Known chain transfer agents can be utilized to control the molecular weight properties of the polymer. Examples of chain transfer agents include dodecanethiol, dodecyhnercaptan, octanethiol, carbon tetrabromide, carbon tetrachloride, and the like in various suitable amounts, for example of about 0.1 to about 10 percent by weight of the total monomers, such as about 0.2 to about 5 percent by weight of monomer.

To achieve a crosslinked polymer, a crosslinking agent such as decanediol diacrylate and/or divinylbenzene is included in the monomer system. The inclusion of a crosslinking agent results in crosslinking of the monomers, thereby forming dense, crosslinked gel particles in the latex.

In embodiments, all polymers for the binder may be formed into a latex for use in the subsequent emulsion aggregation toner particle formation process. Such may be done by mixing the monomer components, including any additive agents as discussed above, in an aqueous phase, optionally in the presence of one or more surfactants, and then polymerizing the monomers, optionally with the use of an initiator. A latex having an aqueous phase with small sized polymer particles therein, for example on the order of about 5 nm to about 500 nm, such as about 50 nm to about 300 nm, is derived. As discussed above, if the monomers include one or more crosslinking agents therein, the resulting latex is a gel latex. Thus, the gel latex comprises submicron crosslinked resin particles suspended in an aqueous water phase, which may contain a surfactant. Any suitable method for forming the latex from the monomers may be used without restriction.

Thus, in embodiments, the toner particles are comprised of a binder including both non-crosslinked polymer and crosslinked polymer, and thus is a mixture of two materials of differing molecular weights. That is, the binder has a bimodal molecular weight distribution (i.e., molecular weight peaks at least at two different molecular weight regions).

For example, in one embodiment, the non-crosslinked polymer has a number average molecular weight (Mn), as measured by gel permeation chromatography (GPC), of from, for example, about 1,000 to about 30,000, and more specifically from about 9,000 to about 13,000, a weight average molecular weight (Mw) of from, for example, about 1,000 to about 75,000, and more specifically from about 25,000 to about 40,000, and a glass transition temperature (Tg) of from, for example, about 45° C. to about 75° C., and more specifically from about 50° C. to about 60° C. The crosslinked polymer, on the other hand, may have a substantially greater molecular weight, for example over 100,000 and preferably over 1,000,000, for Mw, and an onset Tg of from, for example, about 45° C. to about 75° C., such as from about 50° C. to about 62° C. The glass transition temperature may be controlled, for example by adjusting the amount acrylate in the binder. For example, a higher acrylate content can reduce the glass transition temperature of the binder. The higher molecular weight of the crosslinked polymer may be achieved by, for example, including greater amounts of styrene in the monomer system, including greater amounts of crosslinking agent in the monomer system and/or including lesser amounts of chain transfer agents.

The crosslinked gel polymer may be present in an amount of from about 0.5% to about 50% by weight of the total binder, for example from about 5% to about 35% by weight of the total binder, or from about 5% to about 20% by weight of the total binder. The gel portion of the binder distributed throughout the non-crosslinked binder affects the gloss properties of the toner, in particular by reducing gloss. The greater the amount of crosslinked polymer, the lower the gloss, in general.

Various suitable black colorants can be employed without restriction. In embodiments, the toner is a black toner, and thus the colorant includes suitable black colored pigments, dyes, and mixtures thereof. Suitable examples include, for example, carbon black such as REGAL 330 carbon black, acetylene black, lamp black, aniline black, mixtures thereof and the like. The colorant, which may be carbon black, is incorporated in an amount sufficient to impart the desired color to the toner. In general, pigment or dye is employed in an amount ranging from about 2% to about 35% by weight of the toner particles on a solids basis, for example from about 4% to about 25% by weight, such as from about 5% to about 15% by weight of the toner particles on a solids basis. Any other color colorant may also be used and/or included in the toner composition, and the amount included appropriately adjusted to derive the desired end color in the toner.

To incorporate the colorant(s) into the toner, it is preferable for the colorant to be in the form of an aqueous emulsion or dispersion of colorant in water, optionally with use of a surfactant such as an anionic or non-ionic surfactant, where the colorant may be a pigment with a particle size of from about 50 nm to about 300 nm.

In addition to the polymer binder and the colorant, the toners also contain a wax dispersion. The wax is added to the toner formulation in order to aid toner offset resistance, e.g., toner release from the fuser roll, particularly in low oil or oil-less fuser designs. For emulsion aggregation (EA) toners, for example styrene-acrylate EA toners, linear polyethylene waxes such as the POLYWAX® line of waxes available from Baker Petrolite are useful. Examples include POLYWAX 725 or POLYWAX 850. The wax dispersion may also comprise paraffin wax, polypropylene waxes, carnauba wax, paraffin waxes, microcrystalline waxes, other waxes known in the art, and mixtures of waxes. The wax may have a peak melting point of between about 70° C. and about 110° C., for example between about 85° C. and about 100° C.

To incorporate the wax into the toner, it is preferable for the wax to be in the form of an aqueous emulsion or dispersion of solid wax in water, where the solid wax particle size is usually in the range of from about 100 to about 500 nm.

The toners may contain from, for example, about 5 to about 15% by weight of the toner, on a solids basis, of the wax. In embodiments, the toners contain from about 8 to about 12% by weight of the wax.

In addition, the toners contain an amount of the aluminized silica utilized as a coagulant in the emulsion aggregation toner particle formation process. Inclusion of the silica is advantageous as such may act as a flow agent for the toner, and thereby reduce the amount of silica to add as an external additive to an external surface of the toner particle, which results in a cost savings. Conventional coagulants used in the emulsion aggregation art have included multivalent ion coagulants such as polyaluminum chloride (PAC) and/or polyaluminum sulfosilicate (PASS). It has been found, however, that use of aluminized silica as a coagulant is equally as effective, and has the further advantages discussed above. Furthermore, the use of aluminized silica as a coagulant can be very effective in providing cross linking of the resin, which in turn provides a matte finish.

In embodiments, aluminized silica refers to an aluminum treated silica, that is, a silica, and in particular a colloidal silica, in which at least a majority of the silicon atoms on the surface of the silica have been replaced by aluminum. The resulting aluminized silica may be characterized as having an alumina coating upon the silica surface. Aluminized silica is available commercially from various manufacturers, including DuPont, Nalco and EKA Chemicals. Aluminum treated colloidal silica differs from pure silica as the alumina rich surface imparts a positive charge to the colloidal material in aqueous deionized or acidic environments. The polarity difference imparts quite different and advantageous colloidal behavior to the small particles.

The aluminized silica is present in an amount of from, for example, about 0.1 pph to about 50 pph by weight of the toner, such as from about 1 pph to about 50 pph by weight of the toner, for example from about 1 to about 5 pph by weight of the toner.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

In embodiments, the toner particles have a core-shell structure. In this embodiment, the core is comprised of the toner particle materials discussed above, including at least the binder, the colorant, the wax and the aluminized silica. Once the core particle is formed and aggregated to a desired size, a thin outer shell is then formed upon the core particle. The shell may be comprised of only non-crosslinked polymer material the same as that used in the core, although other components may be included in the shell if desired. Thus, the shell latex may be comprised of any of the polymers identified above, for example a styrene acrylate polymer, such as a styrene-butyl acrylate polymer. The shell latex may be added to the core toner particle aggregates in an amount of about 5 to about 40 percent by weight of the total binder materials, for example in an amount of about 5 to about 30 percent by weight of the total binder materials. The shell or coating on the toner aggregates may have a thickness of about 0.2 to about 1.5 μm, for example of about 0.5 to about 1.0 μm.

The total amount of binder, including core and shell if present, may comprise an amount of from about 60 to about 95% by weight of the toner particles (i.e., toner particles exclusive of external additives) on a solids basis, such as from about 70 to about 90% by weight of the toner.

In preparing the toner by the emulsion aggregation procedure, one or more surfactants may be used in the process. Suitable surfactants include anionic, cationic and nonionic surfactants.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, the DOWFAX brand of anionic surfactants, and the NEOGEN brand of anionic surfactants. An example of an anionic surfactant is NEOGEN RK available from Daiichi Kogyo Seiyaku Co. Ltd., which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a nonionic surfactant is ANTAROX 897 available from Rhone-Poulenc Inc., which consists primarily of alkyl phenol ethoxylate.

Any suitable emulsion aggregation procedure may be used in forming the emulsion aggregation toner particles without restriction. These procedures typically include the basic process steps of at least aggregating an aqueous latex emulsion containing the binder polymer(s), colorant(s), wax(es), optionally one or more surfactants, coagulant and any additional optional additives to form aggregates, optionally forming a shell on the aggregated core particles, subsequently optionally coalescing or fusing the aggregates, and then recovering, optionally washing and optionally drying the obtained emulsion aggregation toner particles.

An example emulsion/aggregation/coalescing process includes forming a non-crosslinked polymer latex, for example comprised of a styrene acrylate polymer, forming a crosslinked polymer latex, for example comprised of a crosslinked styrene acrylate polymer, forming a wax dispersion and forming a colorant dispersion, mixing the non-crosslinked polymer latex, crosslinked polymer latex, wax dispersion and colorant dispersion, and adding aluminized silica as a coagulant to the mixture. The mixture is stirred, for example using a homogenizer until homogenized, and then transferred to a reactor where the homogenized mixture is heated to a temperature below the Tg of the binder polymers, for example, to at least about 40° C., and held at such temperature for a period of time to permit aggregation of toner particles to a desired size. Additional aluminized silica may be added to the mixture during heating/aggregation, as desired or required. Additional binder latex, such as non-crosslinked polymer latex, may then be added to form the shell upon the aggregated core particles. Once the desired size of aggregated toner particles is achieved, the pH of the mixture is adjusted in order to inhibit further toner aggregation. The toner particles are further heated to a temperature of, for example, at least about 90° C., and the pH lowered in order to enable the particles to coalesce and spherodize. The heater is then turned off and the reactor mixture allowed to cool to room temperature, at which point the aggregated and coalesced toner particles are recovered and optionally washed and dried.

In preparing the non-crosslinked polymer latex, the polymer may be comprised of at least styrene, butyl acrylate, and β-carboxyethyl acrylate (β-CEA). In embodiments, the composition of the monomers is about 76% styrene, about 24% butyl acrylate and about 3.0 pph of β-CEA, although the monomers as stated are not limited to the particular range or type as has been discussed above. The latex polymer is formed by an emulsion polymerization, in the presence of an initiator, a chain transfer agent and surfactant. The amount of initiator, such as sodium, potassium or ammonium persulfate, may be in the range of about 0.5 to about 3% by weight of the monomers. The amount of chain transfer agent utilized may be in the range of about 1.5 to about 3% by weight of styrene and butyl acrylate. The surfactant utilized may be an anionic surfactant, although not limited, and is in the range of 0.7 to about 5% by weight of the aqueous phase. In embodiments, the emulsion polymerization is conducted under a starve fed polymerized emulsion to provide latex resin particles which are in the size range of about 100 to about 300 nm. The amount of carboxylic acid groups may be selected to be in the range of about 0.05 to about 5 pph of the styrene and butyl acrylate.

In preparing the crosslinked polymer latex, the polymer may be comprised of at least styrene, butyl acrylate, β-carboxyethyl acrylate (β-CEA) and divinylbenzene. In embodiments, the monomer composition is about 65% styrene, about 35% butyl acrylate, about 3 pph of β-CEA and about 1 pph of divinylbenzene, although the composition is not limited. The crosslinked latex polymer may be prepared by an emulsion polymerization, in the presence of an initiator such as a persulfate, a chain transfer agent and surfactant. In embodiments, the degree of crosslinking is in the range of about 2 to about 20%, although not limited, and an increase in the divinylbenzene concentration will increase the crosslinking. The soluble portion of the crosslinked latex may have a Mw of about 135,000 and an Mn of about 27,000. The surfactant utilized may be anionic surfactant such as NEOGEN RK, although not limited. The pH of the latex may be about 1.8.

In preparing the wax dispersion, the wax in embodiments may be a polyethylene wax particle, in particular POLYWAX 850, although not limited. The wax may have a particle diameter in the range of about 100 to about 500 nm. The surfactant utilized to disperse the wax may be an anionic surfactant, although not limited. The wax selected may be a polyethylene, a polypropylene, or carnauba wax, or a functionalized wax. The amount of wax added may be in the range of about 5 to about 20% by weight by weight of the monomers.

In preparing the black colorant dispersion, a carbon black dispersion of REGAL 330 in surfactant, may be prepared. The colorant dispersion may have a pigment particle in the size range of about 50 to about 300 nm. The surfactant utilized to disperse the black colorant may be an anionic and/or non-ionic surfactant, although not limited. An suitable equipment, for example an ultimizer, media mill, etc., may be used to provide the pigment dispersion.

The composite toner particles are, in embodiments, formed by mixing the non-crosslinked polymer latex with a certain quantity of the crosslinked polymer latex, in the presence of the wax and the colorant dispersions. A coagulant of an aluminized silica is added to the mixture while being blended, for example at high speeds, such as by using a polytron or any other suitable equipment. The resulting mixture, for example having a pH of about 2 to about 3, is then aggregated by heating to a temperature below the resin Tg of the non-crosslinked and crosslinked polymers to provide toner size aggregates. The heating may thus be to a temperature of about 40° C. to about 55° C. Once a desired initial size of aggregates is obtained, additional non-crosslinked latex is then added to the formed aggregates, this later addition of latex providing a shell over the pre-formed aggregates. Aggregation continues until the shell is of a desired thickness, i.e., the aggregates have formed a desired overall size. The pH of the mixture is then changed, for example by the addition of a sodium hydroxide solution, to about 7. At this pH, the carboxylic acid becomes ionized to provide additional negative charge on the aggregates, thereby providing stability and preventing the particles from further growth or an increase in the GSD when heated above the Tg of the latex resin. The temperature is thereafter raised to at least about 80° C., for example at least about 90° C., such as from about 80° C. to about 170° C. After about 30 minutes to a few hours, the pH of the mixture is reduced to a value of less than about 5, for example from about 3 to about 4.5, to coalesce or fuse the aggregates with the heat and to provide the composite particle. The particles may be measured for shape factor or circularity using a Sysmex FPIA 2100 analyzer, and coalescence permitted to continue until a desired shape is achieved. The particles are then allowed to cool to room temperature and optionally washed. In embodiments, the washing includes a first wash conducted at a pH of about 10 and at a temperature of about 63° C., followed by a deionized water wash at room temperature, followed by a wash at a pH of about 4 and at a temperature of about 40° C., followed by a final deionized water wash. The toner is then dried and recovered.

In embodiments, the toner particles are made to have an average particle size of from about 1 to about 15 micrometers, for example from about 2 to about 10 micrometers, such as from about 2 to about 7 micrometers, with a shape factor of from about 120 to about 140 and an average circularity of about 0.90 to about 0.98. The particle size may be determined using any suitable device, for example a conventional Coulter counter. The shape factor and circularity may be determined using a Malvern Sysmex Flow Particle Inage Analyzer FPIA-2100. The circularity is a measure of the particles closeness to a perfect sphere. A circularity of 1.0 identifies a particle having the shape of a perfect circular sphere.

The toner particles cohesivity is associated to some degree with the surface morphology of the particles. The rounder/smoother the surface of the particles, the lower the cohesion and the greater the flow. As the surface becomes less round/rougher, the flow worsens and the cohesion increases.

The toner particles may also have a size distribution such that the volume geometric standard deviation (GSDv) for (D84/D50) is in the range of from about 1.15 to about 1.25. The particle diameters at which a cumulative percentage of 50% of the total toner particles are attained are defined as volume D50, and the, particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The GSDv value for the toner particles indicates that the toner, particles are made to have a very narrow particle size distribution.

The toner particles may be blended with external additives following formation. Any suitable surface additives may be used. The external additives may include one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate may also be used as an external additive for the toners herein, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. A commercially available zinc stearate known as Zinc Stearate L, obtained from Ferro Corporation, may be used. The external surface additives can be used with or without a coating.

In embodiments, the toners may contain from, for example, about 0.5 to about 5 weight percent titania (size of from about 10 nm to about 50 nm, for example about 40 nm), about 0.5 to about 5 weight percent silica (size of from about 10 nm to about 50 nm, for example about 40 nm), about 0.5 to about 5 weight percent sol-gel silica and about 0.1 to about 4 weight percent zinc stearate.

The toner particles in embodiments form an image having a matte finish, for example defined herein as having less than about 40 GGU (Gardiner Gloss Units). The toner may thus exhibit a matte type gloss in the range of from, for example, about 15 to about 35 GGU.

The toner particles can optionally be formulated into a developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

A suitable carrier herein is a steel core, for example of about 50 to about 75 μm in size, coated with about 0.5% to about 5% by weight, for example about 1% by weight, of a conductive polymer mixture comprised of methylacrylate and carbon black using the process described in U.S. Pat. No. 5,236,629 and U.S. Pat. No. 5,330,874.

The carrier particles can be mixed with the toner particles in various suitable combinations. The concentrations are usually about 1% to about 20% by weight of toner and about 80% to about 99% by weight of carrier. However, one skilled in the art will recognize that different toner and carrier percentages may be used to achieve a developer composition with desired characteristics.

The toners can be used in known electrostatographic imaging methods. Thus for example, the toners or developers can be charged, e.g., triboelectrically, and applied to an oppositely charged latent image on an imaging member such as a photoreceptor or ionographic receiver. The toner/developer may be supplied from a housing of the imaging device. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll.

The toner particles and preparation thereof will now be further described via the following illustrative examples.

Preparation of non-crosslinked polymer latex A: A latex emulsion comprised of polymer particles generated from the emulsion polymerization of styrene, n-butyl acrylate and β-CEA was prepared as follows. A surfactant solution consisting of 605 grams DOWFAX 2A1 (anionic emulsifier) and 387 kg deionized water was prepared by mixing for 10 minutes in a stainless steel holding tank. The holding tank was then purged with nitrogen for 5 minutes before transferring into the reactor. The reactor was then continuously purged with nitrogen while being stirred at 100 rpm. The reactor was then heated up to 80° C. at a controlled rate. Separately, 6.1 kg of ammonium persulfate initiator was dissolved in 30.2 kg of deionized water. Also separately, the monomer emulsion was prepared by mixing 311.4 kg of styrene, 95.6 kg of butyl acrylate and 12.21 kg of β-CEA, along with 2.88 kg of 1-dodecanethiol, 1.42 kg of decanediol diacrylate (ADOD), 8.04 kg of DOWFAX 2A1 (anionic surfactant), and 193 kg of deionized water to form an emulsion. One percent of the above emulsion is then slowly fed into the reactor containing the aqueous surfactant phase at 80° C. to form the seed particles while being purged with nitrogen. The initiator solution is then slowly charged into the reactor and after 10 minutes, the rest of the emulsion is continuously fed in a using metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank. After drying the latex, the molecular properties were Mw=35, 419, Mn=11,354 and onset Tg=51° C.

Preparation of crosslinked polymer latex B: A crosslinked polymer latex emulsion comprised of polymer gel particles generated from the semi-continuous emulsion polymerization of styrene, n-butyl acrylate, divinylbenzene, and β-CEA was prepared as follows. A surfactant solution consisting of 1.75 kilograms NEOGEN RK (anionic emulsifier) and 145.8 kilograms deionized water was prepared by mixing for 10 minutes in a stainless steel holding tank. The holding tank was then purged with nitrogen for 5 minutes before transferring into the reactor. The reactor was then continuously purged with nitrogen while being stirred at 300 rpm. The reactor was then heated up to 76° C. at a controlled rate and held constant. In a separate container, 1.24 kg of ammonium persulfate initiator was dissolved in 13.12 kg of deionized water. Also in a second separate container, the monomer emulsion was prepared by mixing 47.39 kg styrene, 25.52 kg n-butyl acrylate, 2.19 kg β-CEA, and 729 g of 55% grade divinylbenzene, 4.08 kg of NEOGEN RK (anionic surfactant), and 78.73 kg of deionized water to form an emulsion. The ratio of styrene monomer to n-butyl acrylate monomer by weight was 65 to 35 percent. One percent of the above emulsion is then slowly fed into the reactor containing the aqueous surfactant phase at 76° C. to form the seeds while being purged with nitrogen. The initiator solution is then slowly charged into the reactor, and after 20 minutes the rest of the emulsion is continuously fed in using metering pumps.

Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex, the molecular properties were measured to be Mw=134,700, Mn=27,300 and the onset Tg was 43° C. The average particle size of the gel latex as measured by Disc Centrifuge was 48 nm, and residual monomer as measured by gas chromatography was <50 ppm for styrene and <100 ppm for n-butyl acrylate.

Preparation of aluminized silica solution C: 83 g of 12 nm aluminized silica (available from DuPont) having a solids loading of 29.6% was added to 417 g of deionized water. The resulting solution (Solution C) had a concentration of 0.0492 g/ml.

Toner particle preparation: 289 g of non-crosslinked latex (Latex A) having a solids loading of 40% by weight and 77 g of crosslinked latex resin (Latex B) with a solids loading of 24% was simultaneously added with 69 g of POLYWAX 850 wax dispersion having a solids loading of 30% and 135.29 g carbon black pigment dispersion having a solids loading of 17% by weight, along with 500 g of deionized water, in a vessel and stirred using an IKA Ultra Turrax® T50 homogenizer operating at 4,000 rpm. Thereafter, 45 g of the above solution C was added during the blending stage. The content was then transferred into a reactor and the content heated up 50° C. During the heating step, an additional 120 g of solution C was added and the contents allowed to aggregate. After 160 minutes, the particle size obtained was 4.9 μm with a GSDv of 1.22 as measured by a Coulter counter. 130 g of delayed latex (Latex A) was added and allowed to stir for an additional 20 minutes, resulting in a particle size of 5.4 μm and GSDv of 1.21. The pH of the mixture was raised to 7.0 with 4% NaOH solution and the temperature raised to 90° C. After 15 minutes at 90° C., the pH was lowered to 4.5 with 4% nitric acid solution and allowed to coalesce for 5 hours. The contents was cooled to room temperature and washed 5 times with deionized water and freeze dried. The toner particle size was 6.2 microns with a GSDv of 1.22, and had a circularity of 0.96. The toner was comprised of, by solids weight, 71% non-crosslinked resin, 10% crosslinked resin, 10% REGAL 330 pigment, 9% POLYWAX 850 wax, and 3.5 pph aluminized silica. The toner, when fixed on paper, exhibited a gloss of 220 GGU.

It will be appreciated that various of the above-disclosed and other features and functions, or alternatives therof, may be desirably combined into many other different systems or applications. Also, various presently unforeseen or unanticipated alternatives, modifications or improvements therein may be subsequently made by those skilled in the art, and are also intended to be encompassed by the following claims.

What is claimed is:

1. A toner comprising emulsion aggregation toner particles comprising a core and a shell, wherein the core is comprised of binder including a first non-crosslinked styrene acrylate polymer and a crosslinked styrene acrylate polymer, at least one colorant, at least one wax, and aluminized silica, wherein the shell comprises a second non-crosslinked styrene acrylate polymer, wherein the first and second non-crosslinked styrene acrylate polymers are derived from monomers including styrene, butyl acrylate and β-carboxyethyl acrylate, wherein the crosslinked styrene acrylate polymer is derived from monomers including styrene, butyl acrylate, β-carboxyethyl acrylate and divinylbenzene, wherein the aluminized silica comprises from 1 to 3.5 pph of the toner, wherein the toner is comprised of from about 65% to about 75% by weight of the first and the second non-crosslinked styrene acrylate polymer, from about 5% to about 15% by weight of the crosslinked styrene acrylate polymer, from about 5% to about 15% by weight of the wax, and from about 5% to about 15% by weight of the colorant, and wherein the toner exhibits a gloss of from about 15 to about 35 GGU.

2. The toner according to claim 1, wherein the crosslinked styrene acrylate polymer comprises from about 5% to about 20% by weight of the core binder.

3. The toner according to claim 1, wherein the wax is a polyethylene wax.

4. The toner according to claim 1, wherein the colorant is black, and comprises carbon black.

5. The toner according to claim 1, wherein the first non-crosslinked styrene acrylate polymer and the second non-crosslinked styrene acrylate polymer are the same.

6. The toner according to claim 1, wherein the first non-crosslinked styrene acrylate polymer and the second non-crosslinked styrene acrylate polymer each have a weight average molecular weight of from about 25,000 to about 40,000, a number average molecular weight of from about 9,000 to about 13,000, and an onset glass transition temperature of from about 50° C. to about 60° C.

7. The toner according to claim 1, wherein the crosslinked styrene acrylate polymer has an onset glass transition temperature of from about 50° C. to about 62° C.

8. The toner according to claim 1, wherein the toner particles have an average particle size of from about 2 μm to about 10 μm, an average circularity of about 0.90 to about 0.98, a shape factor of from about 120 to about 140, and a volume geometric standard deviation for (D84/D50) in the range of from about 1.15 to about 1.25.

9. The toner according to claim 1, wherein the toner particles further comprise one or more external additives selected from the group consisting of silica, sol-gel silica, titanium dioxide and zinc stearate.

10. A developer comprising:

a toner comprising emulsion aggregation toner particles comprising a core and a shell, wherein the core is comprised of binder including a first non-crosslinked styrene acrylate polymer and a crosslinked styrene acrylate polymer, at least one colorant, at least one wax, and aluminized silica, wherein the shell comprises a second non-crosslinked styrene acrylate polymer, wherein the first and second non-crosslinked styrene acrylate polymers are derived from monomers including styrene, butyl acrylate and β-carboxyethyl acrylate, wherein the crosslinked styrene acrylate polymer is derived from monomers including styrene, butyl acrylate, β-carboxyethyl acrylate and divinylbenzene, wherein the aluminized silica comprises from 1 to 3.5 pph of the toner, wherein the toner is comprised of from about 65% to about 75% by weight of the first and the second non-crosslinked styrene acrylate polymer, from about 5% to about 15% by weight of the crosslinked styrene acrylate polymer, from about 5% to about 15% by weight of the wax and from about 5% to about 15% by weight of the colorant, and wherein the toner exhibits a gloss of from about 15 to about 35 GGU, and carrier particles.

11. A method of making a toner comprising emulsion aggregation toner particles comprising a core and a shell, wherein the core is comprised of binder including a first non-crosslinked styrene acrylate polymer and a crosslinked styrene acrylate polymer, at least one colorant, at least one wax, and aluminized silica, wherein the shell comprises a second non-crosslinked styrene acrylate polymer, wherein the first and second non-crosslinked styrene acrylate polymers are derived from monomers including styrene, butyl acrylate and β-carboxyethyl acrylate, wherein the crosslinked styrene aerylate polymer is derived from monomers including styrene, butyl acrylate, β-carboxyethyl aeiylate and divinylbenzene, wherein the aluminized silica comprises from 1 to 3.5 pph of the toner, wherein the toner is comprised of from about 65% to about 75% by weight of the first and the second non-crosslinked styrene acrylate polymer, from about 5% to about 15% by weight of the crosslinked styrene acrylate polymer, from about 5% to about 15% by weight of the wax and from about 5% to about 15% by weight of the colorant, and wherein the toner exhibits a gloss of from about 15 to about 35 GGU, the method comprising:

obtaining a latex of the first non-crosslinked styrene acrylate polymer, a latex of the second non-crosslinked styrene acrylate polymer, a latex of the crosslinked styrene acrylate polymer, an aqueous dispersion of the at least one colorant, an aqueous dispersion of the at least one wax, and an aqueous dispersion of the aluminized silica, forming a mixture of the latex of the first non-crosslinked styrene acrylate polymer, the latex of the crosslinked styrene acrylate polymer, the aqueous dispersion of the at least one colorant, and the aqueous dispersion of the at least one wax, adding some or all of the aqueous dispersion of the aluminized silica to the mixture, stirring the mixture, and heating the mixture to a temperature below a glass transition temperature of the first non-crosslinked styrene acrylate polymer and the crosslinked styrene acrylate polymer, any remaining portion of the aqueous dispersion of the aluminized silica being added to the mixture during the heating, maintaining the temperature of heating to form aggregated toner particles, adding the latex of the second non-crossliniced styrene acrylate polymer particles to the aggregated toner particles to form a shell thereon, after formation of the shell, stopping further aggregation by adjusting the pH and raising the temperature to at least about 90° C. to coalesce the aggregated particles, and subsequently cooling, optionally washing, and recovering the emulsion aggregation toner particles.

12. The method according to claim 11, wherein the first non-crosslinked styrene acrylate polymer and the second non-crosslinked styrene acrylate polymer are the same.

13. The process according to claim 11, wherein further aggregation is stopped by raising the pH to at least about 7.

* * * * *

UNITED STATES PATENT AND TRADEMARK OFFICE

CERTIFICATE OF CORRECTION

PATENT NO. : 7,390,606 B2
APPLICATION NO. : 11/250567
DATED : June 24, 2008
INVENTOR(S) : Raj D. Patel et al.

It is certified that error appears in the above-identified patent and that said Letters Patent is hereby corrected as shown below:

Column 13, Line 38, in Claim 11, change “aerylate” to “acrylate”;

Column 13, Line 40, in Claim 11, change “aeiylate” to “acrylate”; and

Column 14, Line 29, in Claim 11, change “non-crosslinicd” to “non-crosslinked”.

Signed and Sealed this

Seventh Day of April, 2009

JOHN DOLL
*Acting Director of the United States Patent and Trademark Office*